United States Patent [19]

Hanley

[11] 4,436,194

[45] Mar. 13, 1984

[54] COIN OPERATED DELIVERY SYSTEM FOR VENDING MACHINES

[76] Inventor: James O. Hanley, 12838 Burwell Dr., Minnetonka, Minn. 5

[21] Appl. No.: 519,845

[22] Filed: Aug. 3, 1983

[51] Int. Cl.[3] ..... G07F 5/02

[52] U.S. Cl. ..... 194/63; 221/75

[58] Field of Search ..... 221/75; 194/61, 63, 194/64–66

[56] References Cited

U.S. PATENT DOCUMENTS

| | | | |
|---|---|---|---|
| 2,321,136 | 6/1943 | Grau | 194/61 |
| 4,046,440 | 9/1933 | Cox et al. | 221/75 X |
| 4,061,245 | 12/1977 | Lotspeich | 221/75 |

*Primary Examiner*—Stanley H. Tollberg
*Attorney, Agent, or Firm*—Burd, Bartz & Gutenkauf

[57] ABSTRACT

A coin operated delivery system for manual dispensing of products from vending machines. The system, being manually operable and of relatively simple construction, is intended for use in low volume sales locations where the use of large expensive electrically operated vending machines cannot be justified because of insufficient sales volume. The system comprises an elongated open top horizontal channel in which is disposed an elongated helix of substantially the same length. The coils of the helix are widely spaced apart to receive the individual items of product to be dispensed between the adjacent coils. The helix is linked to a rotatable coin receiver mechanism. Upon insertion of a coin, the coin receiving mechanism and the helix may be rotated through one full rotation to force the unit of product contained in the outermost coil of the helix to be discharged from the channel. The system is adaptable to vending of products whose purchase price may be represented by one or more coins of appropriate denomination.

9 Claims, 10 Drawing Figures

COIN OPERATED DELIVERY SYSTEM FOR VENDING MACHINES

BACKGROUND OF THE INVENTION

1. Field of the Invention

This invention is directed to a coin operated delivery system for machines for dispensing articles such as prepackaged snack foods, candy bars, chewing gum, sandwiches, and the like. The system is characterized by the fact that delivery of the desired product is accomplished manually by rotation of a coin receiver coupled to a helical product holder. The system is especially adapted for dispensing products at low volume locations. Its construction is simple and its operation is easy.

2. The Prior Art

The coin operated snack vending machine is ubiquitous. It is found wherever large numbers of hungry people pass or congregate. It is found in public buildings such as schools, hospitals, transportation terminals, and the like, and in places of employment such as shops, factories, offices, and the like. Most such vending machines are large, complicated, electrically operated, and dependent upon relatively large sales volume. Small shops, factories, offices, and the like, which have a relatively small work force, are at a disadvantage because the volume of business generated does not justify the installation of one of the available expensive vending machines.

Many employees appreciate the convenience of being able to purchase food at their place of employment. Most employers prefer the greater efficiency, productivity, and employee satisfaction gained by providing on-site food facilities. Various "honor" systems have been used in small volume locations. However, pilferage and non-payment is a frequent problem often necessitating removal of such systems. The delivery system of the present invention is especially adapted to satisfy the needs of low volume demand locations in a secure pilferage resistant manner.

SUMMARY OF THE INVENTION

Broadly stated, the coin operated delivery system for a product vending machine according to the present invention comprises an elongated open top horizontal channel adapted to be enclosed within a vending machine housing. An elongated helix is horizontally disposed and supported for rotation within the channel. The coils of the helix are widely spaced apart so as to receive loosely between each pair of adjacent coils a vertically disposed product to be dispensed. The helix is of such a length that one end extends at least to the corresponding end of the channel. A vertically disposed coin receiver, adapted to be supported on the outside of the vending machine housing, is linked through an appropriate opening to the opposite end of the helix. The coin receiver, when containing the requisite amount of money, is capable of manual rotation in one direction through at least one full rotation to rotate the helix through one rotation. This causes the discharge from the remote end of the helix and channel of one unit of product contained within the helix. The product is pushed off the end of the channel by rotation of the helix and falls into an area accessible to the purchaser for removal from the machine.

IN THE DRAWINGS

The invention is illustrated in the accompanying drawings in which the same parts are identified by the same numerals and in which.

DETAILED DESCRIPTION OF THE PREFERRED EMBODIMENT

Figure 4:
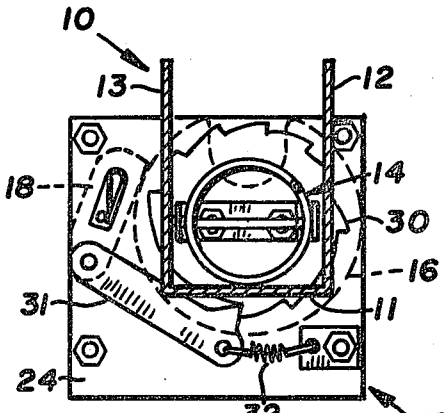
FIG. 4 is a rear elevation partly in section on the line 4—4 of FIG. 2.
Figure 3:
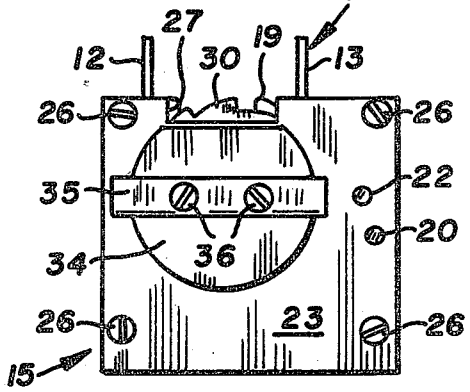
FIG. 3 is a front elevation thereof.
Figure 1:
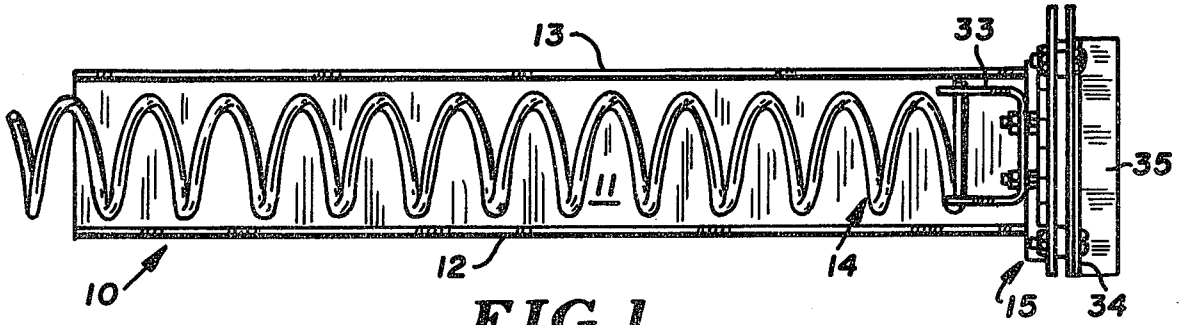
FIG. 1 is a top plan view of the delivery system according to the present invention.

Referring now to the drawings, and particularly to FIGS. 1 through 4, the coin operated delivery system for a product vending machine according to the present invention comprises an elongated open top channel, indicated generally at 10. The channel is intended to be supported horizontally within a vending machine housing of the usual rectangular design so as to extend perpendicularly rearwardly from the front wall and spaced from the rear wall sufficiently to permit the vended product to fall therebetween. As shown, the channel comprises a bottom wall or floor 11, spaced apart vertical side walls 12 and 13. The width and depth of channel 10 are dictated by the dimensions of the product to be vended so as to support and guide the product in its movement along the channel. For products such as candy bars and chewing gum, the channel may be relatively narrow. For products such as packaged potato chips, sandwiches, etc., the channels are correspondingly wider. The housing, as is usual, includes a transparent panel or window to enable a customer to determine that a product is available.

An elongated helix, indicated generally at 14, is disposed in the bottom of channel 10 for rotation therein. The adjacent coils of helix 14 are relatively widely spaced apart, the space between each adjacent pair of coils being adapted to receive one unit of the product to be vended. Thus, as in the case of channel 10, the diameter of helix 14 and the relative spacing between adjacent coils thereof is dictated by the dimensions of the product. The helix should fit loosely for rotation within the channel and the items of product should fit loosely within the helix so that upon rotation of the helix the items of product are advanced from the front end of the channel to the rear end thereof. The length of helix 14 is such that it extends at least to the rearward end of the channel so that the rearwardmost item of product is pushed out of the channel upon rotation of the helix. From there, as is usual, the product drops into a chute or chamber in the vending machine housing below the channel which is accessible by the purchaser who may simply reach in and retrieve the product purchased.

A coin receiver mechanism, indicated generally at 15, is adapted for mounting on the outside front wall of a vending machine housing to connect through the wall to the end of the helix. The structure of the coin receiver mechanism, and its operation, are best understood by reference to FIGS. 5 through 10. The invention is illustrated with reference to a device operable by a single coin. However, the device is readily adaptable for operation by insertion of two or more coins, as dictated by the price of the product being vended.

Figure 5:
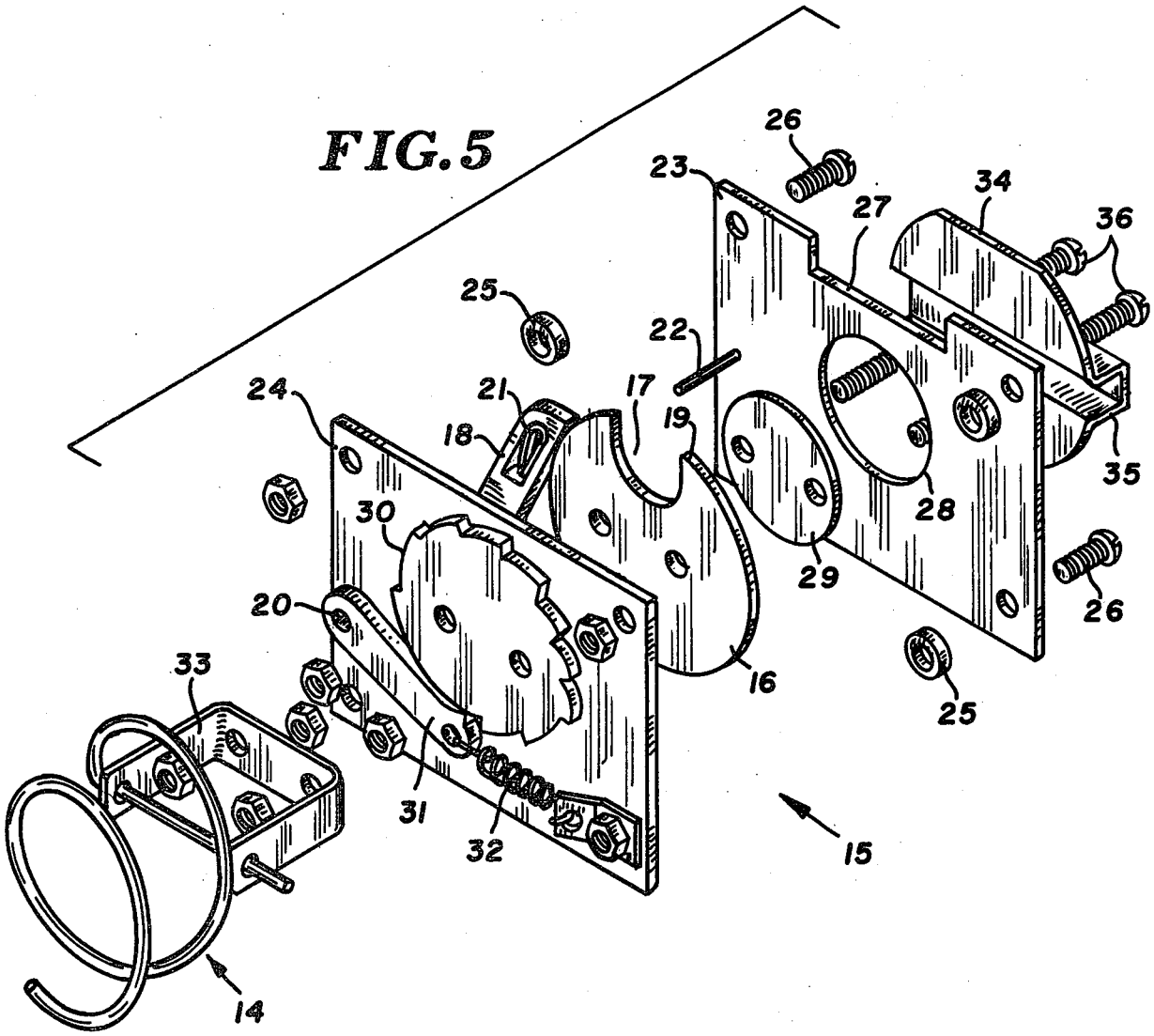
FIG. 5 is an exploded view of the coin receiver mechanism and its linkage to the product delivering helix.

Referring to FIG. 5, the coin receiving mechanism comprises a disc 16 having a recess 17 in its periphery which is adapted to receive a coin of appropriate denomination with a close but loose fit. The depth of recess 17 is such that when a coin is inserted therein the outermost edge of the coin extends to or slightly above what would be the peripheral edge of the disc, were it not for the recess. Thus, as disc 16 is rotated with a coin in place in slot 17, pawl 18 is prevented from engaging lip 19 at the edge of recess 17, as occurs when no coin is present. Pawl 18 is pivoted on a pin or screw 20. It is biased to engage the edge of coin disc 16 by means of a sear spring 21 housed within a slot in the pawl, one arm of the spring bearing against a fixed pin 22.

Coin disc 16 and pawl 18 are sandwiched between a flat front plate 23 and flat rear plate 24 held spaced apart by means of appropriate spacers 25 and held together by fasteners, such as screws or bolts 26, or the like. If the coin receiver is intended to receive more than one coin, then a separate coin disc 16 and pawl 18 are provided for each coin and sandwiched between additional front plates 23.

Each such front plate 23 has a notch 27 in its top edge to facilitate insertion of the coin. Front plate 23 also has a circular opening 28 below recess 27. A bearing disc 29, which is fastened to coin disc 16, as hereinafter explained, fits in and rotates in opening 28. Rear plate 24 has a similar opening, not shown, in which a similar rear bearing disc rotates.

A ratchet wheel 30 is disposed against the rearward surface of rear plate 24. Ratchet wheel 30 has teeth over about three-fourths of its periphery. A pawl 31, pivotally supported by screw or pin 20, is biased by coil spring 32 into engagement with the toothed periphery of the ratchet wheel. The ratchet wheel carries a rearwardly extending yoke 33 by which helix 14 is linked to the coin receiver mechanism.

A knob or handle 34 is disposed against the outside surface of the outermost front plate 23. The top edge of knob 34, when the knob is at normal at-rest position, is flattened to coincide generally with the edge of recess 27 in plate 23 to facilitate insertion of the coins. Knob 34 preferably includes a bar 35 which is parallel to the flattened top edge of the knob. Bar 35 permits easy rotation of the knob when engaged by finger and thumb and facilitates orientation of the coin receiving mechanism for beginning of the product dispensing cycle. Knob 34, bearing disc 29, coin disc 16, ratchet wheel 30, and yoke 33 are all fastened together, as by means of screws or bolts 36, to rotate as a single unit.

The operation of the coin receiving mechanism is shown sequentially in FIGS. 6 through 10. Because helix 14 rotates along with the rotatable elements of the coin receiving mechanism, it will be readily seen how the individual items of product held within the helix and channel are moved along the channel by rotation of the coin receiving mechanism.

Figure 6:
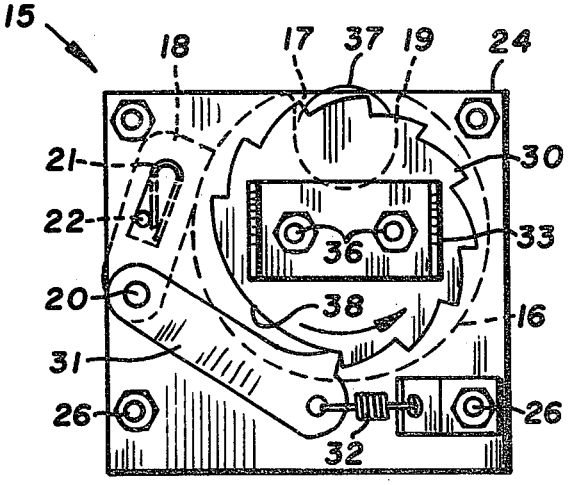
FIGS. 6 through 10 are rear elevations of the coin receiving mechanism, showing the several successive rotational steps of the coin receiver and associated parts during the manual operation of the delivery system.
Figure 7:
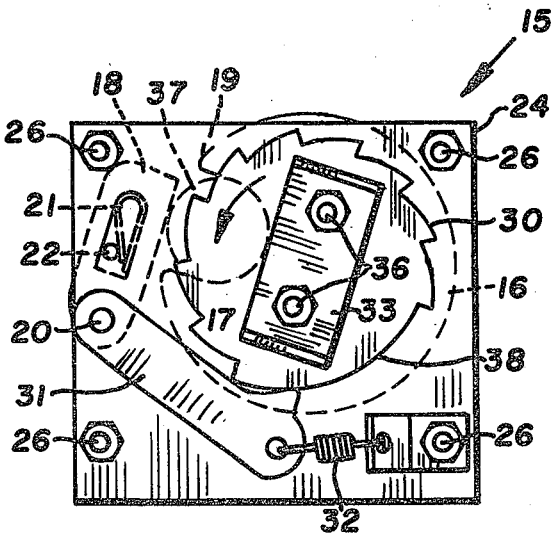

In FIG. 6, the coin receiving mechanism is shown in its normal at-rest position ready to receive a coin 37 which is inserted in recess 17. The coin receiving mechanism is adapted to be rotated clockwise from the purchaser's viewpoint or counterclockwise, as seen in the view from the rear represented by FIG. 6. Counterclockwise movement (from the purchaser's viewpoint) is prevented by pawl 31 engaging ratchet wheel 33. However, the knob and associated mechanism can be rotated clockwise and, as seen in FIG. 7, the edge of coin 37 engages pawl 18 and pushes it outwardly against the tension of sear spring 21 sufficiently far to prevent engagement of the pawl with lip 19 on the periphery of the coin disc. During this approximate quarter turn of the knob and associated mechanism, pawl 31 engages the relatively long start ramp 38 on the periphery of the ratchet wheel.

Figure 8:
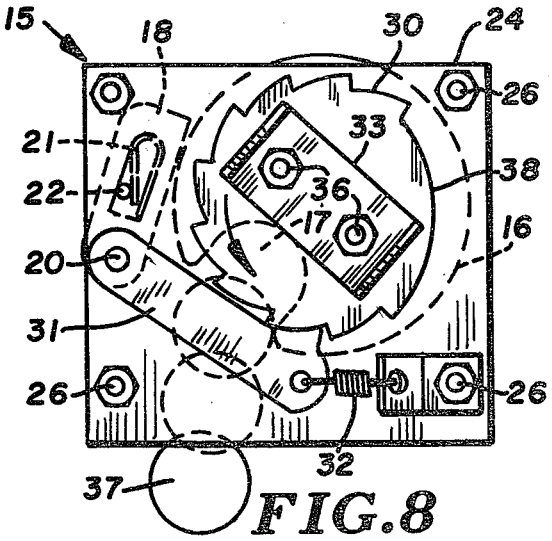

As rotation of the mechanism continues, coin 37 falls by gravity from the coin disc, as shown in FIG. 8, to be collected in any suitable box or other container. Pawl 18 rides freely on the smooth periphery of the coin disc. Reverse rotation is prevented by pawl 31 engaging the closely spaced teeth of the ratchet wheel.

Figure 9:
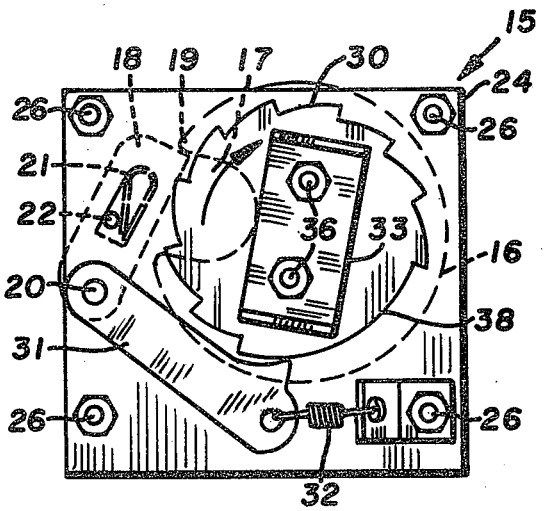

Rotation of the knob and associated mechanism continues for approximately one and one-fourth turns until, as shown in FIG. 9, further rotation is prevented by pawl 18 engaging lip 19 of the coin disc 16 because of the absence of a coin in the disc. By this time, because of the rotation of helix 14 through more than one full turn, the item of product being vended has been pushed off the rearward end of the channel and delivered to the purchaser. Pawl 31 again engages the relatively long start ramp 38 of the ratchet wheel.

Figure 10:
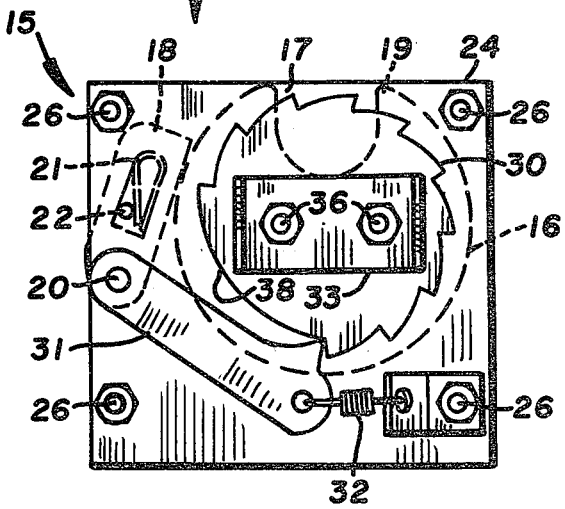

Because of this, as seen in FIG. 10, the direction of rotation may now be reversed approximately a quarter turn until pawl 31 again engages a tooth of the ratchet wheel to prevent further rotation. As seen in FIG. 10, the mechanism is now returned to its normal at-rest position ready to receive a further coin in recess 17. Because the items of product being vended are loosely supported within the helix and channel, the product slides along freely in response to rotation of the helix.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A coin operated delivery system for a product vending machine comprising:
   (A) an elongated open top horizontal channel,
   (B) an elongated horizontally disposed helix within said channel,
      (1) the coils of said helix being widely spaced apart to receive loosely therebetween a vertically disposed product to be dispensed,
      (2) one end of said helix extending at least to the corresponding end of the channel, and
   (C) a vertically disposed rotatable coin receiver mechanically linked directly to the opposite end of the helix, said coin receiver when containing the requisite amount of money being capable of manual rotation through at least one full rotation to rotate the helix through its direct mechanical linkage through one full rotation to discharge in a front to rear direction one unit of product contained therein from the remote end of the channel.

2. A coin operated delivery system according to claim 1 wherein said channel includes a bottom wall and side walls of dimension corresponding to the dimensions of the product to be dispensed to support the product and guide its movement longitudinally through the channel.

3. A coin operated delivery system according to claim 2 wherein the diameter of the helix is just slightly less than the width of the channel to permit free rotation of the helix within the channel.

4. A coin operated delivery system for a product vending machine comprising:

(A) an elongated open top horizontal channel, (B) an elongated horizontally disposed helix within said channel, (1) the coils of said helix being widely spaced apart to receive loosely therebetween a vertically disposed product to be dispensed, (2) one end of said helix extending at least to the corresponding end of the channel, and (C) a vertically disposed rotatable coin receiver directly linked mechanically to the opposite end of the helix, said coin receiver when containing the requisite amount of money being capable of manual rotation through at least one full rotation to rotate the helix through its direct mechanical linkage through one full rotation to discharge one unit of product contained therein from the remote end of the channel, said coin receiver comprising:

(1) at least one coin receiver disc having a coin receiving recess in the peripheral edge thereof, (2) a spring biased pawl in engagement with the peripheral edge of said coin disc, said pawl engageable with the disc to prevent rotation thereof except when a coin is present in the recess, (3) a ratchet wheel linked to said coin disc for rotation therewith, (4) a spring biased pawl engaging the periphery of said ratchet wheel to limit counter-rotation of the mechanism, and (5) a knob linked to said coin disc and ratchet wheel for manual rotation thereof.

5. A coin operated delivery system according to claim 4 wherein said ratchet wheel is untoothed over about one-fourth of its periphery to permit limited counter-rotation of the coin receiver.

6. A coin operated delivery system according to claim 4 further characterized in that a yoke is secured to said ratchet wheel for rotation therewith and one end of said helix engages said yoke for rotation therewith.

7. A coin operated delivery system for a product vending machine comprising:

(A) an elongated open top horizontal channel, said channel including a bottom wall and side walls of dimension corresponding to the dimensions of the product to be dispensed to support the product and guide its movement longitudinally through the channel, (B) an elongated horizontally disposed helix within said channel, (1) the coils of said helix being widely spaced apart to receive loosely therebetween a vertically disposed product to be dispensed, (2) one end of said helix extending at least to the corresponding end of the channel, (3) the diameter of the helix being just slightly less than the width of the channel to permit free rotation of the helix within the channel, and (C) a vertically disposed rotatable coin receiver linked to the opposite end of the helix, said coin receiver when containing the requisite amount of money being capable of manual rotation through at least one full rotation to rotate the helix through one full rotation to discharge one unit of product contained therein from the remote end of the channel, said coin receiver comprising:

(1) at least one coin receiver disc having a coin receiving recess in the peripheral edge thereof, (2) a spring biased pawl in engagement with the peripheral edge of said coin disc, said pawl engageable with the disc to prevent rotation thereof except when a coin is present in the recess, (3) a ratchet wheel linked to said coin disc for rotation therewith, (4) a spring biased pawl engaging the periphery of said ratchet wheel to limit counter-rotation of the mechanism, and (5) a knob linked to said coin disc and ratchet wheel for manual rotation thereof.

8. A coin operated delivery system according to claim 7 wherein said ratchet wheel is untoothed over about one-fourth of its periphery to permit limited counter-rotation of the coin receiver.

9. A coin operated delivery system according to claim 7 further characterized in that a yoke is secured to said ratchet wheel for rotation therewith and one end of said helix engages said yoke for rotation therewith.

* * * * *

UNITED STATES PATENT AND TRADEMARK OFFICE

CERTIFICATE OF CORRECTION

PATENT NO. : 4,436,194

DATED : March 13, 1984

INVENTOR(S) : James O. Hanley

Figure 2:
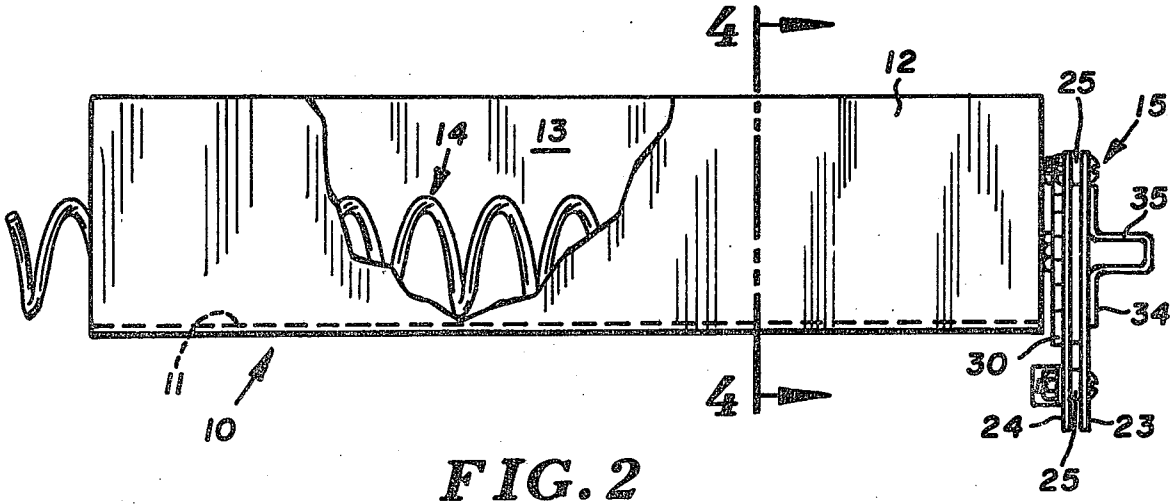
FIG. 2 is a left side elevation thereof.

It is certified that error appears in the above-identified patent and that said Letters Patent is hereby corrected as shown below:

Column 2, line 11, after "FIG. 2", --and in the direction of the arrows-- is omitted.

Signed and Sealed this

*Nineteenth* Day of *June 1984*

[SEAL]

*Attest:*

GERALD J. MOSSINGHOFF

*Attesting Officer*

*Commissioner of Patents and Trademarks*